United States Patent [19]

Regaldo

[11] 4,390,286

[45] Jun. 28, 1983

[54] PLANT COMPOSED OF MULTI-FUNCTIONAL APPARATUS FOR DELIVERING SUBSTANCES FOR TREATING ROADWAYS OR THE LAND, AND WHICH CAN BE SELF-LOADED FROM THE GROUND ON TO THE PLATFORM OF A TRANSPORTER VEHICLE, AND VICE VERSA

[76] Inventor: Pietro Regaldo, C.so Agnelli, 81, Torino, Italy

[21] Appl. No.: 354,881

[22] Filed: Mar. 4, 1982

[30] Foreign Application Priority Data

Jul. 29, 1981 [IT] Italy ..... 68054 A/81

[51] Int. Cl.[3] ..... B01F 15/02; B01F 7/26

[52] U.S. Cl. ..... 366/186; 366/15; 366/136; 366/290; 366/297; 366/317; 414/498

[58] Field of Search ..... 366/14, 15, 26, 27, 366/30, 34, 40, 42, 52, 64, 66, 167, 168, 184, 290, 291, 299, 308, 295, 136, 317, 315, 297, 186; 414/498

[56] References Cited

U.S. PATENT DOCUMENTS

| | | | |
|---|---|---|---|
| 2,487,887 | 11/1949 | McEachran | 366/15 |
| 2,872,166 | 2/1959 | Roberts | 366/290 |
| 3,168,291 | 2/1965 | Knoedler et al. | 366/290 |
| 3,215,408 | 11/1965 | Hansen | 366/290 |
| 3,424,438 | 1/1969 | Knotts et al. | 366/167 |
| 3,425,835 | 2/1969 | Johnson et al. | 366/184 |
| 3,995,760 | 12/1976 | Burgdorf et al. | 414/498 |
| 4,053,073 | 10/1977 | Franchin | 414/498 |
| 4,090,623 | 5/1978 | Noyon | 414/498 |

FOREIGN PATENT DOCUMENTS

| | | | |
|---|---|---|---|
| 703402 | 2/1965 | Canada | 366/30 |
| 758329 | 1/1934 | France | 366/40 |

*Primary Examiner*—Robert W. Jenkins
*Assistant Examiner*—Thomas W. Epting
*Attorney, Agent, or Firm*—Young & Thompson

[57] ABSTRACT

A motor-transportable plant for delivering substances for treating roadways or the land, in which a tank is divided by a wall into two separate chambers, each accessible through a manhole, and which can be connected together by opening valves provided in the wall; one of said chambers comprises stirring means for a liquid and a solute contained in the chamber, and means for withdrawing the formed solution and feeding it to the outside of the tank, a motor being provided for said withdrawal and for feeding the solution; the second chamber comprises stirrer means and means for withdrawing a solid material contained in the chamber and for feeding it to distributors therefor; said stirrer and withdrawal means are extractable from the chamber through an aperture closable by means of a suitable cover; the tank is supported by a rigid quadrilateral frame provided with legs which can extend by hydraulic control and are each provided with orthogonal shafts which are inserted into the cross members of the frame to define, using locking means, respective horizontal and vertical positions of the legs in which these latter either lie against or are distant from the frame, each shaft having a length greater than one half the length of the cross member into which it is inserted, and a diameter different from the opposite shaft which is also inserted into the cross member, so that one shaft can itself be inserted into the other when the legs lie against the frame.

5 Claims, 9 Drawing Figures

PLANT COMPOSED OF MULTI-FUNCTIONAL APPARATUS FOR DELIVERING SUBSTANCES FOR TREATING ROADWAYS OR THE LAND, AND WHICH CAN BE SELF-LOADED FROM THE GROUND ON TO THE PLATFORM OF A TRANSPORTER VEHICLE, AND VICE VERSA

DESCRIPTION

The invention relates to a plant composed of multi-functional apparatus for delivering substances for treating roadways or the land, the plant being able to be self-loaded from the ground on to the platform of a transporter vehicle and vice versa.

There exists at the present time machines able to carry out washing operations on horizontal and vertical surfaces, machines for spraying solutions for agricultural and industrial operations for herbicide, fertilising and disinfestation purposes, machines comprising equipment for spreading solid inert and chloride material of various particle sizes, machines for spraying preconstituted anti-freezing solutions in winter road maintenance work, and machines comprising special equipment for the cleaning and unblocking of underground pipes, and for the vacuum extraction of liquids and sludges comprising debris from underground wells and conduits.

All the aforesaid machines and other machines comprising special equipment not listed heretofore are suitable for carrying out only one or at the most two of the listed operations.

Thus the utilisation of such machines during the year is limited or intermittent. Consequently, in order to cover the needs of the various operations required in the maintenance of civil or industrial buildings and road infrastructures, and in the winter maintenance of roads, these being carried out usually by the machines heretofore described, a firm which specialises in the maintenance of the various specified infrastructures needs to possess a very wide range of different machines in order to carry out all the necessary individual operations. The firm therefore has to invest a considerable amount of capital for purchasing a large number of different machines, this leading to high interest payments, high depreciation and maintenance costs, the need to provide large storage space for housing the vehicles, and the need for the large number of employees required for operating each individual machine.

This all leads to an increase in the hourly cost of each service performed. In addition, existing plants are permanently fixed to a transporter vehicle, and when they are not being used their supporting vehicle is compelled to remain inoperative.

In the utility model application No. 52852-B/78 of Jan. 24, 1978, the applicant proposed a frame fixed to the plant and resting on the ground by means of suitable legs fitted with feet fixed to the rods of hydraulic cylinders, so that the frame together with the plant could be lifted from the platform of the transporter vehicle, so enabling the plant to be released and removed from the vehicle.

The main object of the invention is to provide a plant composed of an apparatus suitable for multiple use such as to cover all the operations required in the maintenance of buildings, and road and airport infrastructures, including the winter period, i.e. during the entire year.

In attaining this object, the proposed plant comprises a tank divided by a wall into two chambers, of which one is designed to contain liquid or a liquid solution and the other is designed to contain solid substance; suitable valves in the wall enable the two chambers to be directly connected together.

The proposed plant is therefore composed of apparatus suitable for carrying out any of the following operations when the valves are closed and consequently the two chambers are separate:

1. washing and disinfesting horizontal and vertical surfaces by means of water or various solutions in the form of a high pressure jet at 60–70 atm.;

2. cleaning and washing road gulleys and traps, and unblocking and cleaning underground pipes, using water;

3. suction by means of a rotary vacuum pump or a screw pump for drawing up dense liquids and sludges, possibly in association with debris of various kinds, from wells, ponds, and surface or underground conduits;

4. turning large volumes of solid products into liquid form; forming solutions, including highly saturated solutions, and delivering them under pressure in controlled quantities through multiple utilisation conduits;

5. containing, transporting, discharging and spreading, by means of a rotary centrifugal spreader, inert quarry or river bed materials, and salts of various particle sizes or in the form of fragments, such as NaCl, $CaCl_2$ etc.

When however the valves are open and thus the two chambers are connected together, the overall capacity of the tank can be utilised for the following services:

6. containing various liquids or solutions to such an extent that the time for which the plant can operate under any of the modes described in points 1, 2, 3 or 4 is increased by the addition of the capacity of the second chamber to the first;

7. operation as a plant particularly suitable for draining, emptying, washing or unblocking underground conduits, industrial and road weed removal, and prevention and removal of ice and snow deposits on road, motorway and airport infrastructures.

A further object of the invention is to enable the plant to be separated from the vehicle by using a frame for supporting the plant and allowing it to rest on the ground, which is more simple and functional than existing frames, and in particular than that representing the subject matter of the aforesaid utility model application. By means of this frame, it is possible to use the vehicle for other purposes, even during the short periods in which the plant is out of use for maintenance and cleaning reasons.

These and further objects which will be more apparent hereinafter are attained according to the invention by a plant composed of multi-functional apparatus for delivering substances for the treatment of roadways or the land, characterised by comprising a tank divided by a wall into two separate chambers each accessible through a manhole, and which can be connected together by opening valves provided in the wall, one of said chambers comprising agitator means for a liquid and a solute contained in said chamber so as to form a complete solution of the solute in the liquid, motor means being provided for withdrawing and delivering the solution, the second chamber comprising second agitator means for solid material contained in the chamber, and means for withdrawing it and feeding it to distributor means therefor, said second agitator and withdrawal means being extractable from the chamber through an aperture which can be closed by means of a suitable cover; the tank being supported by a rigid quadrilateral frame provided with legs which can extend under hydraulic control and are each provided with orthogonal shafts which are inserted into the cross members of the frame in order to define, by the use of locking means, respective horizontal and vertical positions of the legs in which they lie against or are distant from the frame, each shaft having a length greater than one half of the cross member into which it is inserted, and a diameter different from the shaft opposite which is also inserted into the cross member, so that one shaft can be inserted into the other when the legs lie against the frame.

A description is given hereinafter of a preferred embodiment of the invention by way of non-limiting example, with reference to the accompanying drawings in which:

FIGS. 1, 2 and 3 show the various components of the plant.

Figure 1:
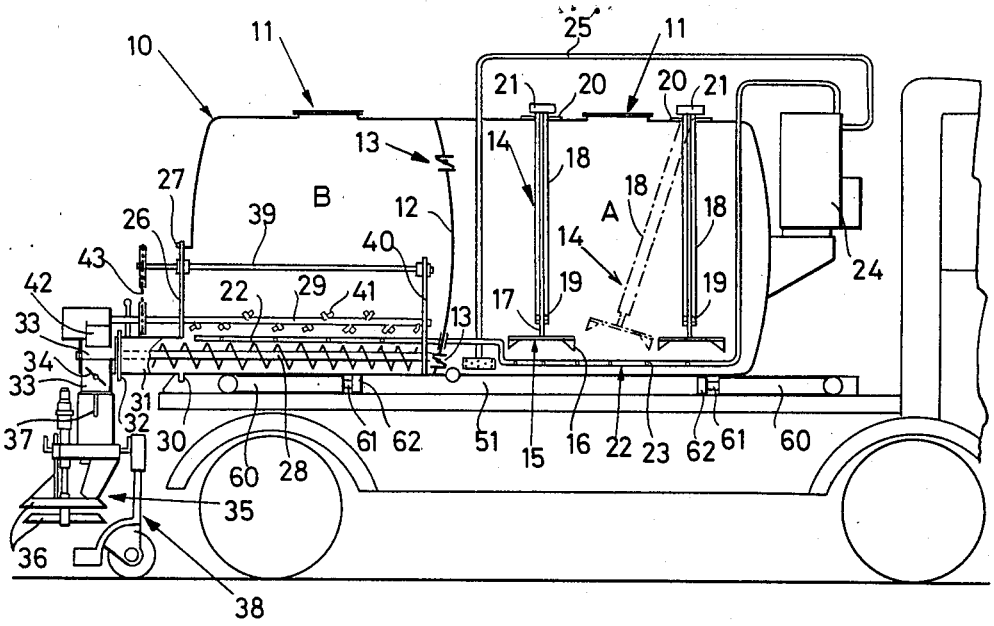
FIG. 1 is a longitudinal section through the plant according to the invention carried by a vehicle

A tank 10 has a capacity which is chosen according to the degree of autonomy required in carrying out the scheduled amount of work.

The tank 10, which is usually constructed with a plate steel shell, is provided with two manholes 11 fitted with tightly closing covers.

The tank 10 is divided internally into two chambers or compartments A and B by means of a plate wall 12 welded to the inner circumference of the tank.

The two chambers A and B can be connected together by opening suitable valves or flaps 13 either hinged or welded to the wall and operable manually from the outside or inside of the tank. The chamber A is designed mainly to contain the liquid product. For this reason, the chamber is fitted with a system for rapidly dissolving the solid substances disposed in the liquid solvent, and if required for spraying the solution obtained under pressure in a controlled quantity.

An apparatus of this type forms the subject matter of Italian Pat. No. 980,566 of the present applicant. The said system also operates in chamber B if required.

Chamber A also contains special mechanical elements known as centrifugal agitators 14. The centrifugal agitators 14 are elements suitable for accelerating the turbulence of the liquid (solvent) which is associated with the solid (solute) in the chamber A. The action of the centrifugal agitators considerably reduces the time required for dissolving the solid, so as to give the solute, which can be NaCl or other substances, its maximum concentration and saturation in the solution. Although NaCl is mentioned, the action is valid for all solutes which can be dissolved in a liquid.

The centrifugal agitator 14 comprises a disc 15, the bottom of which is provided with pockets and bulges 16. The disc 15 is fixed to the lower end of a shaft 17 rotatably disposed in a tubular support 18 provided with rolling bearings 19. The support 18 can assume a vertical position or an inclined position (shown by dashed and dotted lines) according to requirements, and is fixed by bolts 20 to the outside of the top of the tank 10. On the top of the support 18 externally to the shaft 17 there is fixed a hydraulic or electric motor 21, which transmits the required rotation through the shaft 17 to the disc 15.

One or more centrifugal agitators 14 can be mounted in the chamber A. The number of centrifugal agitators is determined by the liquid holding capacity and the dimensions of the chamber A. Each centrifugal agitator 14 is independent of the others in that each one comprises its own motor 21, which can be either hydraulic, or electric suitable for any determined current. A suction pipe 25 provided with a filter dips into the chamber A, and is connected to that end outside the tank to the pump unit 24. The pump unit 24 returns the solvent liquid into the chamber A through a second pipe 22 by way of a pressure regulating valve which causes the solvent liquid to emerge at a determined high pressure of about 55–65 atm. from the nozzles 23 provided in the pipe 22, in the horizontal part thereof contained in the chamber A, and which continues and terminates at the end of the chamber B having passed through the wall 12.

The action determined by the high pressure of the liquid generates strong turbulence in the solvent and solute contained in the tank, this turbulence making it possible to strongly facilitate the dissolving of the solute until it reaches maximum saturation in the solution produced. The solution produced can then be delivered by said pump unit 24 under pressure and in controlled quantity through the various pipes fitted to the plant for carrying out the multiple services required of it.

A suitable valve (not shown) operated from the outside of the tank starts and stops the delivery and jet action and consequent dissolving action by the nozzles 23 disposed in that part of the pipe 22 located in the chamber B.

The rear chamber of the tank 10 disposed behind the chamber A relative to the direction of forward travel and indicated by the reference letter B is designed mainly for containing solid material, which can be inert material, sodium chloride NaCl in granular state of different particle sizes or powder, calcium chloride $CaCl_2$ in the form of fragments or granules, or any other solid product of varying particle size, even solids which cannot be dissolved in a liquid. If required, the chamber B can also contain and generate solutions if the features of the liquid system are incorporated therein. In this case, the delivery capacity of the plant is increased by the capacity of chamber B. At the rear of the tank there is a steel plate 26 for closing the chamber B. The plate 26 is fixed to the tank by bolts 27, and by means of appropriate supports it allows rotation of a worm 28 and stirrer shafts 29 disposed inside the chamber B.

A tube 31 of indeterminable length is bolted by means of a flange 30 to the bottom of the plate 26, and at its rear end it is connected by means of a flange 32 to a tube 33. This latter is provided at its bottom with a bore where a vertical branch is provided housing a butterfly valve of the tight shut-off type. Below the butterfly valve 34 there is connected a vertical extension of the tube 33. The complete spreading unit 35 for the solid material is mounted at a fixed point over the outer circumference of the tube 33 by means of a vertically slidable sleeve, and its disc 36 is driven at a controlled r.p.m. by a suitable electric or hydraulic motor. The unit 35 is not described in detail herein as it is of current and thus widely known construction.

In order to operate the solid material distributor, the butterfly valve 34 must be opened so that the material urged by the worm 28 through the tube 33 falls through the bore of the (open) valve 34, and passes into the pipe 35 to then deposit on the spreading disc 36 of the unit 35. The spreading unit 35 is not fixed to the tube 33, and thus its distance from the ground can be varied and adjusted vertically and, if required, locked at the point determined by the operator (as shown by way of example at 37 in FIG. 1). The unit 35 can be provided with a trolley 38 guided by guide wheels running on the road. The purpose of the trolley is to keep a determined distance between the spreading disc 36 and the road surface, while absorbing, by means of the sliding facility provided for the tube 33, any jolts created by the suspension or by the variable distance of the load-bearing platform from the road caused by the expansion of the leaf springs upwards, following the progressive unloading of the material during service.

Three pins 39 disposed at a suitable distance apart, are fixed to the plate 26 and are bolted at their other ends to the plate 40 in such a manner that the plate 26, the three pins 39 and plate 40 together form a frame within which the shaft carrying the worm 28 for discharging the solid material and the stirrer shafts 29 (which can be more than one in number) fitted with projections 41 can rotate on relative rolling bearing supports and carry out their work. The shaft supporting the discharge worm 28 is rotated by a hydraulic or electric motor 42 connected to it, and also driving the stirrer shafts 29 by way of V belts 43 (gears or chains).

Figure 2:
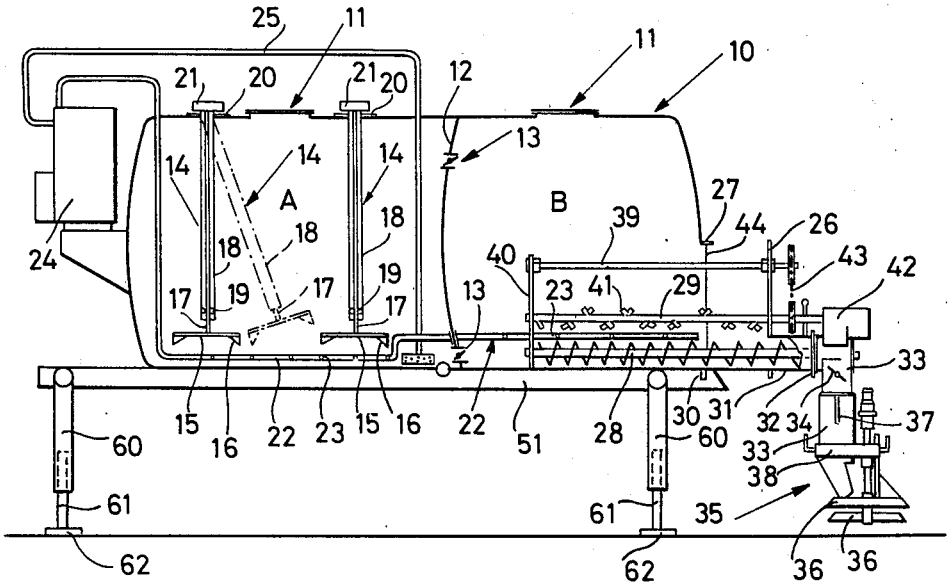
FIGS. 2 and 3 are both longitudinal sectional side views, taken from two opposite sides, of a plant according to the invention resting on the ground, in which in FIG. 3 each plant component is assembled, whereas in FIG. 2 a constituent apparatus of the plant is being removed.
Figure 3:
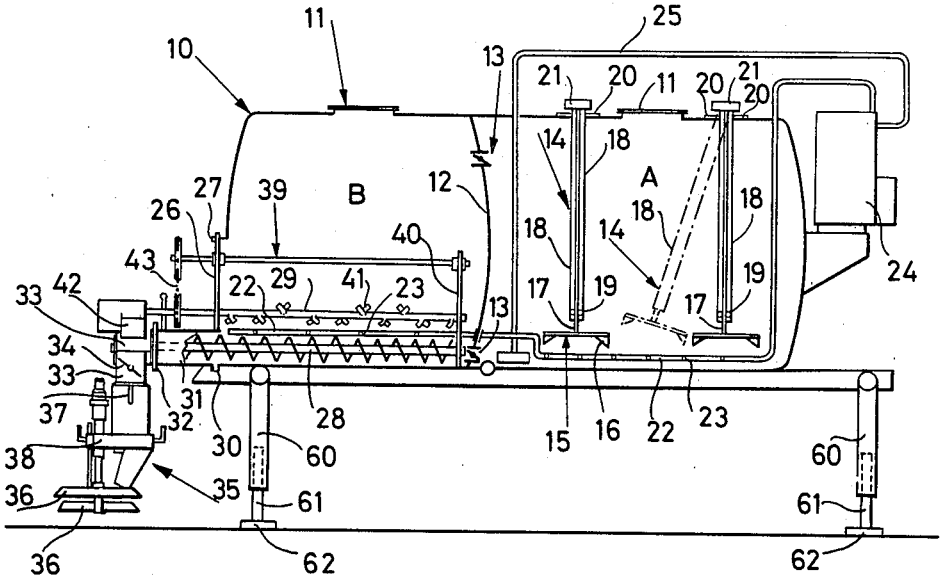

The distributor unit for the solid material is assembled in the workshop. Then, in order to mount the unit on the distributor machine, the device must be inserted into the chamber B from the end associated with the plate 40, by passing it through the hole 44 (as shown in FIG. 2), and pushing the entire unit until the bores in the plate 26 pass over the bolts 27 disposed for clamping the unit to the tank. By means of the reverse operation, the distributor unit can be extracted from the chamber B and deposited in some other place, or can be fitted to another machine of the aforesaid type. The opening 44 which remains uncovered in the tank after removing the distributor unit and plate 26, is covered by fitting a cover (not shown) provided with a pipe and a suitable valve for closing and opening said pipe in order to partly or totally discharge any liquid contained in the tank.

Figure 5:
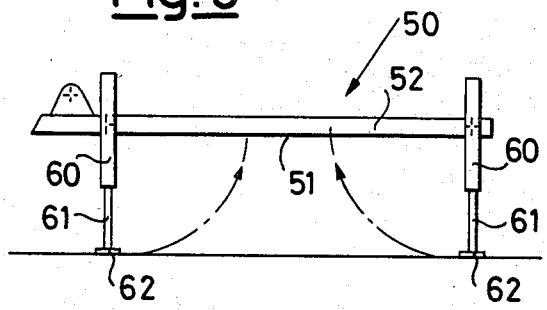
FIGS. 5, 6 and 7 are side, front and plan views respectively of the plant support frame
Figure 6:
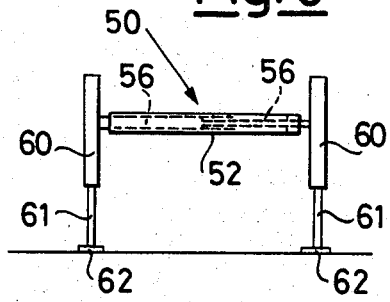
Figure 7:
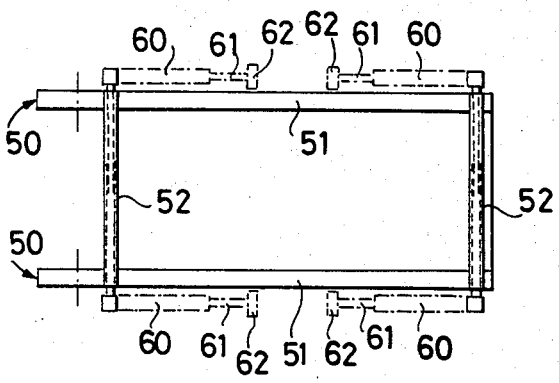

As also shown in FIGS. 5, 6 and 7, the plant is superposed on a frame 50 which is composed of two longitudinal members 51 in the form of steel channel sections, joined together at their ends by welded tubular cross members 52.

Figure 4:
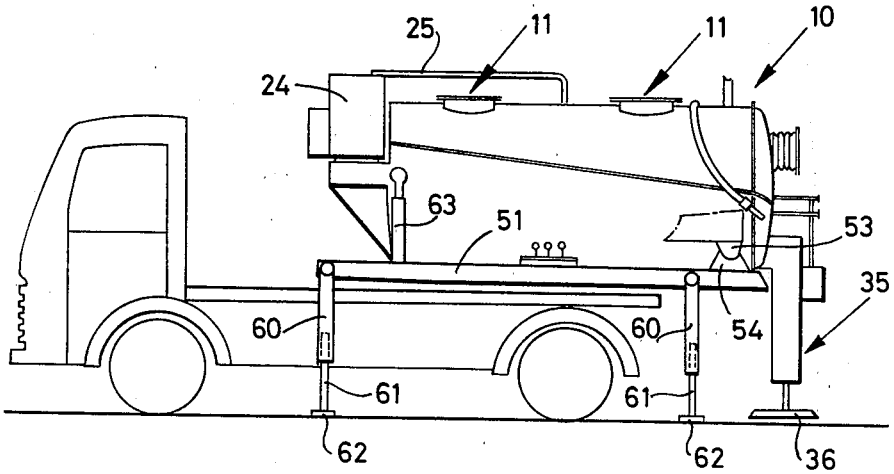
FIG. 4 is a side view of the plant resting on the ground during the approach or withdrawal of the vehicle

The plant rests on the frame at four points, and is fixed to it by pins passing through bores in bosses 53 (FIG. 4), brackets and lugs welded to the sides of the tank 10 and welded to the rear end of the longitudinal members so as to enable the entire assembly to operate as a hinge for the rearward tilting of the tank. The tank is tilted or levelled by the action of the two double acting hydraulic cylinder actuators 63 hinged to the front end of the longitudinal members 51 and connected by means of their rod to the outside of the tank (FIG. 4).

The hydraulic cylinders can lower and raise the tank at the front in order to level the plant horizontally as required by any level differences in the road infrastructures, this position being the optimum position for proper operation of the plant.

The hydraulic cylinder actuators 63 can raise the tank at its front almost to the vertical position in order to displace the material in the tank chambers towards the rear end, this being the end for discharging the product through the appropriate pipes after opening the discharge valves.

The plant superposed on the frame is raised from the ground and deposited on to the ground by four legs coupled to the bores of each frame cross member 52. This ground support frame is constituted in accordance with the technical characteristics already illustrated in the utility model application No. 52852-B/78 in the name of the present applicant.

Each of the legs 55 is in the form of a hydraulic jack, of which the cylinder is indicated by the reference numeral 60 and the rod by 61. At the end of each rod there is provided a ground support foot 62.

Figure 8:
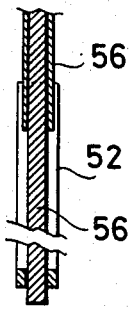
FIG. 8 is a section through a detail of the frame
Figure 9:
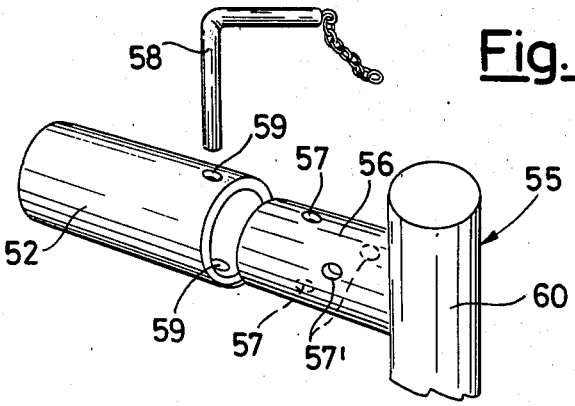
FIG. 9 is an enlarged view of a further detail of the frame.

As can be seen in FIG. 8, a long lateral tubular shaft 56, rotatably and slidably mounted in one of the tubular cross members 52, extends from the head of each cylinder 60.

This type of connection allows rotation of each leg and jack 55, 56, 60, 61, 62 between a vertical position (FIGS. 2–7) and a horizontal position (FIG. 1), and also enables each leg 55 to move between a position in which the leg is distanced from the adjacent longitudinal member 51 of the frame, and a position in which the horizontally disposed leg lies substantially against said longitudinal member, as indicated by dashed and dotted lines in FIG. 7.

The four legs 55 can be locked either in the vertical position distant from the frame, or in the raised horizontal position close to the frame. For this purpose, as shown in FIG. 8, in the end of each tubular cross member 52 adjacent to the relative leg 55 there is provided a pair of vertically aligned diametrically opposing bores 59. The tubular shaft 56 comprises corresponding aligned pairs of bores 57 and 57', the axes of alignment being perpendicular to each other but spaced apart in the longitudinal direction of the shaft 56. A locking pin 58 can be inserted into the bores 57 and 59 in order to lock the leg 55 in the vertical extended position, or into the bores 57' and 59 in order to lock it in the raised horizontal position.

A fundamental characteristic of the proposed design is that the two shafts 56 inserted into each cross member 52 have a different cross-section and a length which is greater than one half the length of said cross member. Thus in FIG. 7 it can be seen that the ends of the two shafts 56 of a cross member 52 are inserted one into the other when the legs 55 are turned horizontally and lie close to the frame. Consequently, when the legs 55 are spaced apart in the cross members 52 so that they are at their maximum distance from the frame, and locked at that point by the pin 58 in the bore 57, the cylinders 60 are spaced apart by such a distance that when the rods of the jacks 60, 61 are suitably extended, a bridge remains having a width sufficient to insert rearwards therebetween the loading platform of a truck which, when correctly positioned, receives the plant with its frame on lowering the cylinder rods.

The hydraulic cylinders 60, 61 operate independently of each other, and are controlled by a central hydraulic feed unit which serves the various hydraulic requirements of the various hydraulic circuits of the plant.

When the plant is deposited on the transporter vehicle, the rods 61 are totally reinserted into their cylinders 60, the pins 58 are removed from the bores 57, thus releasing the horizontal shafts 56, the legs 55 are rotated, the cylinders move them to their correct horizontal position, and the legs are then pushed until they make contact with the ends of the longitudinal members 51 (FIG. 7).

This is possible because the leg shafts 56, having different diameters, penetrate one into the other in telescopic manner, so enabling the cylinders to lie so that they are contained within the outline of the loading platform of the transporter vehicle.

For greater safety, the plant is fastened to the platform by metal ropes, each provided with a tensioning device which when screwed down puts the ropes under tension, these then firmly holding the plant on the platform if the vehicle brakes at speed.

What we claim is:

1. A plant composed of multi-functional apparatus for delivering substances for the treatment of roadways or the land, characterised by comprising a tank divided by a wall into two separate chambers each accessible through a manhole, and which can be connected together by opening valves provided in the wall, one of said chambers comprising agitator means for a liquid and a solute contained in said chamber so as to form a complete solution of the solute in the liquid, motor means being provided for withdrawing and delivering the solution, the second chamber comprising second agitator means for solid material contained in the chamber, and means for withdrawing it and feeding it to distributor means therefor, said second agitator and withdrawal means being extractable from the chamber through an aperture which can be closed by means of a suitable cover; the tank being supported by a rigid quadrilateral frame provided with legs which can extend under hydraulic control and are each provided with orthogonal shafts which are inserted into the cross members of the frame in order to define, by the use of locking means, respective horizontal and vertical positions of the legs in which they lie against or are distant from the frame, each shaft having a length greater than one half the length of the cross member into which it is inserted, and a diameter different from the shaft opposite which is also inserted into the cross member, so that one shaft can be inserted into the other when the legs lie against the frame.

2. A plant as claimed in claim 1, characterised in that the agitator means of the first chamber are in the form of tubular supports, in each of which there rotates a motor-driven shaft provided at one end with a disc rigid therewith and dipping into the chamber, the support being able to be swivelled inside the chamber.

3. A plant as claimed in claim 1, characterised in that the means for dissolving the solute in the liquid are constituted by a pipe with a filter, the pipe dipping into the chamber and connected to a pump which feeds the solution to a second pipe provided with bores and located in said chamber, and passing through the wall to continue into the second chamber so that it can be made active or inactive in this latter by opening or closing a valve disposed in said solution pipe.

4. A plant as claimed in claim 1, characterised in that the second agitator and withdrawal means of the second chamber are constituted respectively by a shaft comprising protuberances and by a worm, these being rotated by a motor and supported at their ends by two plates connected together by longitudinal cross members in such a manner as to form a frame which can be inserted through an aperture in the tank at the end of the chamber.

5. A plant as claimed in claim 1, characterised in that the distributor means for the material contained in the second chamber are constituted by a spreader disc which can be adjusted in level relative to the road surface and is supplied with the material fed by the agitator means, in a quantity which can be controlled by manually operated valve members.

* * * * *